US007895689B2

(12) United States Patent
Hayes et al.

(10) Patent No.: US 7,895,689 B2
(45) Date of Patent: Mar. 1, 2011

(54) BED ASSEMBLY

(75) Inventors: Stephen Hayes, Dudley (GB); Stephen Hollyoak, Kingswinford (GB)

(73) Assignee: Huntleigh Technology Limited (GB)

( * ) Notice: Subject to any disclaimer, the term of this patent is extended or adjusted under 35 U.S.C. 154(b) by 0 days.

(21) Appl. No.: 11/996,032

(22) PCT Filed: Jul. 17, 2006

(86) PCT No.: PCT/GB2006/002633

§ 371 (c)(1),
(2), (4) Date: Jun. 18, 2008

(87) PCT Pub. No.: WO2007/010218

PCT Pub. Date: Jan. 25, 2007

(65) Prior Publication Data

US 2008/0295248 A1 Dec. 4, 2008

(30) Foreign Application Priority Data

Jul. 20, 2005 (GB) ..... 0514926.5
Nov. 14, 2005 (GB) ..... 0523168.3

(51) Int. Cl.
*A47B 7/02* (2006.01)

(52) U.S. Cl. ..... 5/618; 5/617; 5/400; 5/613

(58) Field of Classification Search ..... 5/618, 5/617, 400, 613
See application file for complete search history.

(56) References Cited

U.S. PATENT DOCUMENTS 3,013,281 A 12/1961 Steiner
3,051,965 A 9/1962 Szemplak et al.
3,209,379 A 10/1965 Reinhold
3,355,695 A 11/1967 Overesch
4,183,015 A 1/1980 Drew et al.
4,805,265 A 2/1989 Ehm et al.
5,398,357 A 3/1995 Foster
5,634,532 A 6/1997 Bucher et al.
5,732,423 A 3/1998 Weismiller et al.
5,862,551 A * 1/1999 Oguma et al. ..... 5/618

(Continued)

FOREIGN PATENT DOCUMENTS

DE 35 16 081 A1 11/1986

(Continued)

*Primary Examiner*—Robert G Santos
*Assistant Examiner*—Brittany M Wilson
(74) *Attorney, Agent, or Firm*—Craig A. Fieschko, Esq.; DeWitt Ross & Stevens S.C.

(57) ABSTRACT

A bed assembly (10) includes a frame (22) which supports four curved mattress support panels (50-56) which are able to move with pivoting of the various parts of the frame (22). The curved panels (50-56) better conform to a patient's body shape and provide an effective lengthening of the mattress support (50-56), particularly when the back rest (30, 50) is raised to a sitting position. The support panels (50-56) are located below the pivot points of the frame (22), which further enhances the lengthening effect. The assembly also includes first and second patient retention panels (80, 82) with complementary edges (92, 94) which can slide over one another. A key pad unit (100) protrudes from the retention panel (80) at a convenient patient position and can be gripped by a patient's hand.

24 Claims, 8 Drawing Sheets

U.S. PATENT DOCUMENTS

| | | | | |
|---|---|---|---|---|
| 5,987,673 | A | 11/1999 | Smith | |
| 6,212,713 | B1 | 4/2001 | Kuck et al. | |
| 6,321,878 | B1 | 11/2001 | Mobley et al. | |
| 6,389,622 | B1 | 5/2002 | Her et al. | |
| 6,486,792 | B1 | 11/2002 | Moster et al. | |
| 6,505,365 | B1 | 1/2003 | Hanson et al. | |
| 6,789,280 | B1 * | 9/2004 | Paul | 5/617 |
| 7,406,729 | B2 * | 8/2008 | Hornbach et al. | 5/613 |
| 7,533,429 | B2 * | 5/2009 | Menkedick et al. | 5/611 |
| 2001/0011393 | A1 | 8/2001 | Brooke et al. | |
| 2002/0178502 | A1 | 12/2002 | Beasley et al. | |
| 2004/0177443 | A1 | 9/2004 | Simmonds et al. | |
| 2004/0181876 | A1 | 9/2004 | Takeuchi | |
| 2004/0200646 | A1 | 10/2004 | Waters et al. | |
| 2005/0028281 | A1 * | 2/2005 | Ooyama et al. | 5/618 |
| 2005/0039263 | A1 * | 2/2005 | Reed et al. | 5/618 |
| 2007/0220677 | A1 * | 9/2007 | Dewert | 5/618 |

FOREIGN PATENT DOCUMENTS

| | | | |
|---|---|---|---|
| DE | 199 12 335 | A1 | 9/2000 |
| DE | 101 41 491 | A1 | 3/2003 |
| EP | 0 381 293 | A | 8/1990 |
| EP | 0 561 749 | A | 9/1993 |
| EP | 0 788 786 | A2 | 8/1997 |
| EP | 1 408 190 | A | 4/2004 |
| EP | 1 435 211 | A | 7/2004 |
| FR | 2 711 520 | A | 5/1995 |
| GB | 603 530 | A | 6/1948 |
| GB | 1 134 417 | A | 11/1968 |
| GB | 2 311 000 | A | 9/1997 |
| WO | WO 96/01066 | A | 1/1996 |
| WO | WO 98/11858 | A | 3/1998 |
| WO | WO 2004/107923 | A | 12/2004 |

* cited by examiner

BED ASSEMBLY

FIELD OF THE INVENTION

The present invention relates to a bed assembly and to a mattress support.

BACKGROUND OF THE INVENTION

Modem hospital beds are generally designed to be configurable into a variety of profiles. Typically, they are provided with a plurality of sections which can be tilted or otherwise moved to change a patient's position on the bed. For example, they are usually provided with a back rest section which can pivot from a substantially flat position to a raised sitting position, with a thigh rest section which can be pivoted from a substantially flat position to a knee raised position, and with leg rest section coupled to the thigh rest section and able to be raised with the thigh rest section while keeping the feet in a lower position or while keeping the feet in a raised position.

Beds having such functions are well known in the art and generally work satisfactorily. However, there are concerns in the operation of such beds, relating particularly to the fact that when one of the bed portions rotates upwardly relative to an adjacent bed section there is a compression effect on the patient, which can be particularly unpleasant. Furthermore, such beds can cause discomfort to any patient kept on the bed for prolonged periods, at worst leading to the onset of bed sores and other ailments.

SUMMARY OF THE INVENTION

The present invention seeks to provide an improved bed assembly and mattress support.

According to an aspect of the present invention, there is provided a substantially rigid mattress support for a bed including a back rest section which is curved in a transverse direction to the mattress support.

It has been found that a curved back rest support improves patient comfort. It is understood the reason for this is that the traditional mattress support, being flat, generates particular pressure points at the patient's areas of greatest pressure, that is the protruding parts of a patient's body. A mattress, although being resilient, can only partially mitigate this disadvantage. A curved back rest support conforms more closely with the curves of a patient's back so is able to provide more even support. Furthermore, it has been discovered that a curved back rest of this nature provides a greater contact area, thereby spreading the pressure of a patient's weight more evenly and reducing high pressure areas which can lead to the development of bed sores and other ailments.

In the preferred embodiment the mattress support is formed of a plurality of substantially rigid mattress support sections which are movable relative to one another, including a backrest section, a thigh rest section and a leg rest section. There may also be provided a seat section, although in some embodiments the seat section may simply be a hinged area between the back rest section and the thigh rest section.

With a curved back rest section, the mattress support can be arranged such that the lowermost part of the back rest section, that is its central portion, moves away from the seat section as it pivots upwardly. This has an important advantage as during such a motion, which raises the patient to a sitting position, the patient's rear tends to lengthen as a result of stretching. Thus, the action of moving the lowermost part of the back rest section away from the seat section effectively increases the length of the mattress support to accommodate the stretching of the patient. As the mattress placed on the mattress support is typically resilient, the mattress can accommodate this lengthening effect.

Preferably, the thigh rest and leg rest sections are also curved in the transverse direction of the mattress support. Advantageously, the seat section, where provided, is similarly curved.

The provision of a curved seat section, or thigh rest section where provided, augments the amount by which the lowermost part of the back rest section moves away from the seat or thigh rest section and hence the amount of lengthening of the mattress support.

The structure is such that the sections can also move together when pivoted downwardly, as would occur when the knee break is raised. This is advantageous in that it provides a compressing effect on the mattress rather than a stretching effect which occurs with prior art systems. A stretching effect causes the mattress no longer to provide satisfactory support at the knee break whereas compressing the mattress as with the discloses structure allows the mattress to maintain its support characteristics at the knee break and elsewhere.

Advantageously, the sections of the mattress support are removable, for washing and the like.

In the preferred embodiment, the portions of the mattress support are formed from blow moulded plastics material. This provides sections which are light but rigid and thus easily handled by hospital staff when removed from a bed, for example for cleaning.

According to another aspect of the present invention, there is provided a bed assembly including a platform as specified herein.

BRIEF DESCRIPTION OF THE DRAWINGS

Embodiments of the present invention are disclosed below, by way of example only, with reference to the accompanying drawings, in which.

DETAILED DESCRIPTION OF PREFERRED EMBODIMENTS OF THE INVENTION

Figure 1:
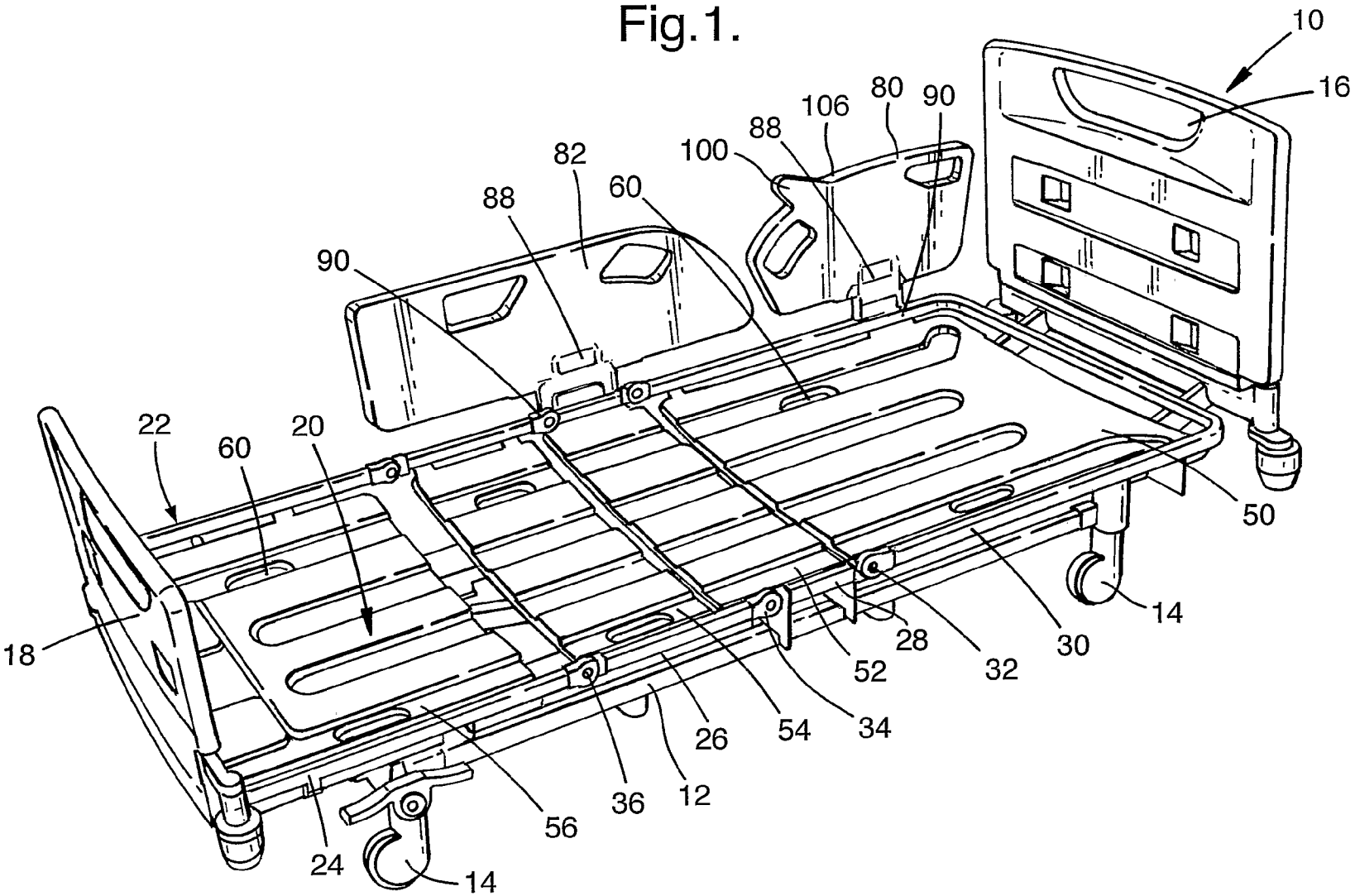
FIG. 1 shows a left-side perspective view from above of a preferred embodiment of a bed assembly in a flat configuration.

Referring to FIG. 1, there is shown a preferred embodiment of bed assembly 10 which includes a wheeled base 12 provided with four castors 14, a headboard 16 and footboard 18. Coupled to the base 12 is a bed platform 20 which can be raised and lowered relative to the base 12 and tilted by means of one or more electrical actuators (not shown), also of conventional type.

The platform 20 is provided with a frame 22 formed, in this embodiment, of four frame sections 24, 26, 28 and 30 which are coupled to one another by means of hinged joints 32, 34 and 36. The frame 22 is typically made of metal or a metal alloy.

Each frame section 24-30 is provided with an upper frame member having substantially vertical inner side walls 38 (better seen in FIGS. 2 and 3) and a plurality of depending transverse struts 40 (better seen in FIGS. 3 and 4) which form a recessed support surface for supporting, in this embodiment, four mattress support panels 50, 52, 54 and 56. These panels 50-56, together with the pivoting frame members 24-30, form respectively the backrest section, seat section, thigh rest section and leg rest section typically found in conformable beds of this nature.

The hinges 32, 34 and 36 are provided in the upper frame members 24-30 and enable the frame members to pivot relative to one another about the hinges 32-36, as will be apparent from a consideration of FIGS. 2, 3 and 7 to 9, and described in detail below. It can be seen that the hinges 32-36 are built into the upper frame members 24-30 and present substantially smooth outer surfaces in order to prevent any discomfort or injury to the patient or care staff.

Figure 11:
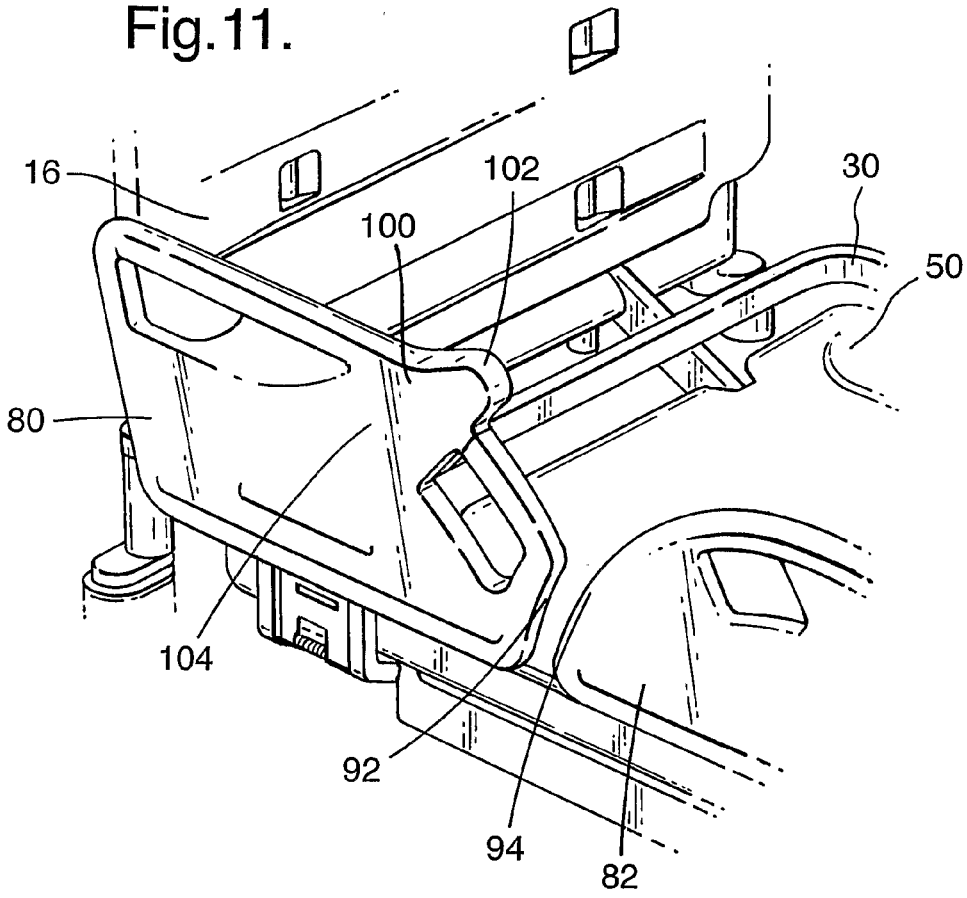
FIG. 11 is an enlarged view of a part of the bed assembly of FIG. 1.

As can be seen in FIG. 1, the mattress support panels 50-56 are curved so as to present a concave upper surface when looking down on the bed platform 20. The panels 50-56 lie below the frame walls 38, preferably by a distance sufficient to allow a mattress placed on the panels 50-56 to fit within the frame 22 so as to be held by the substantially vertical side surfaces provided by the walls 38 of the frame 22. That distance is preferably less than this so that the upper surface of the mattress extends above the frame 22, to hold the patient comfortably above the hard surfaces of the frame 22 (as shown in FIG. 11).

At least some of the mattress support panels 50-56 are preferably removable and advantageously made of blow mouldings from any suitable plastics material. The panels 50-56 are rigid.

Cut-outs 60 in the panels 50-56 provide handles for easy removal of the panels 50-56 from the bed 10 and for their handling. There are preferably also provided snap fittings 55 (some of which are visible in FIG. 10) on the underside surfaces of the panels 50-56 which snap onto the transverse struts 40 to retain the panels in place. In the preferred embodiment, each snap fitting is formed from one or more bosses extending beyond the lower surfaces of the panels 50-56, the bosses having curved surfaces which form a snap fit gripper member which snaps on to the struts 40.

FIG. 1 also shows two patient retention panels 80, 82. Typically, corresponding retention panels are provided on the other side of the bed assembly 10 but are omitted from FIG. 1 for the purposes of clarity. These panels, which can be of a type known in the art, can be moved between the raised position shown and a lowered position in which they lie alongside the frame 22 so as to be below the level of the mattress of the bed. In the raised position the panels 80, 82 retain a patient on the bed, while in the lowered position they enable a patient to get off and get onto the bed and also provide unimpeded access to the patient.

Figure 2:
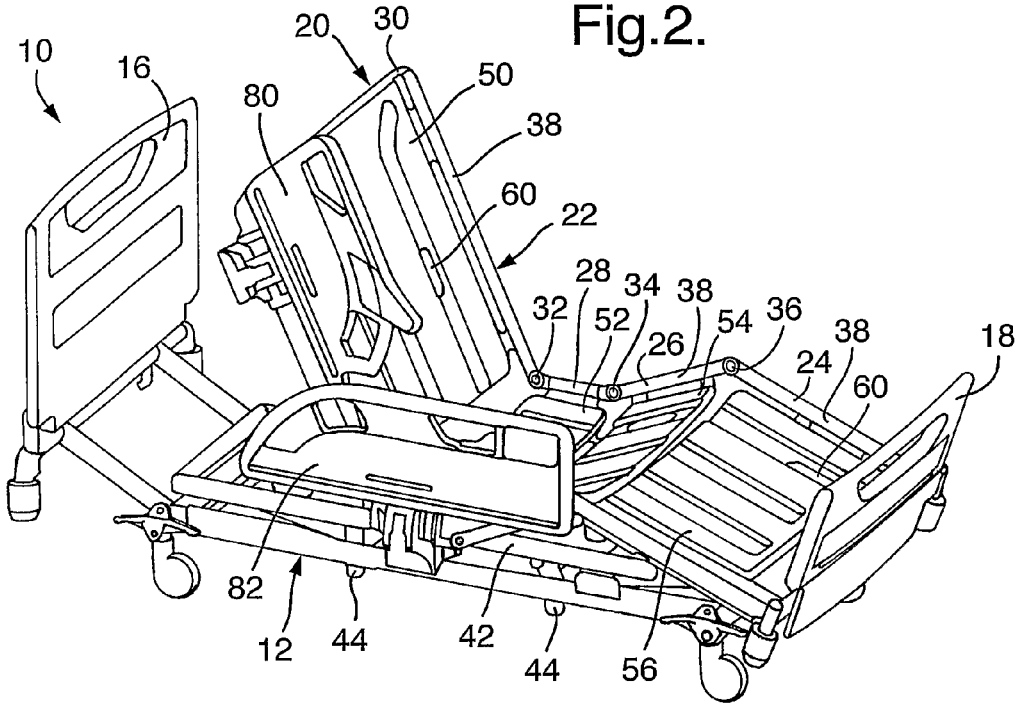
FIG. 2 shows a right-side perspective view from above of the bed assembly of FIG. 1 in a chair configuration.

Referring now to FIG. 2, the bed assembly of FIG. 1 is shown in a chair configuration. In this configuration the back rest 30, 50 is raised by pivoting of the hinge 32 between the back rest section 30 and the seat section 28. In the configuration shown the hinge point 36 between the thigh rest 54 and the leg rest 56 is also raised. This raised configuration of the hinge 36 represents a knee break such that in the configuration shown in FIG. 2 a patient would be sitting up with knees raised.

The various sections 24-30 of the frame 22 can be moved in the manner shown by means of one or more actuators provided in the bed assembly 10. The actuators are well known in the art, as is the type of control system used to control them, so they will not be described in further detail herein.

The bed sections 24-30 and actuators allow the bed to be reconfigured from the lying position shown in FIG. 1 to a sitting position as shown in FIG. 2 and also into many other configurations, including, for example one in which the knee break at hinge 36 is raised and the leg rest section 24 also raised upwardly to keep a patient's legs substantially horizontal. For this latter configuration, there is provided an actuator which is coupled to the leg rest section 24 to effect such movement. This actuator arrangement is well known in the art so is not described in further detail herein.

FIG. 2 also shows a sub-frame 42 which supports the platform 20, typically by being attached to the seat section 28 and also to the actuators and to a control unit. The sub-frame 42 also supports the struts 44 which raise and lower the sub-frame 42 and hence the platform 20 relative to the base 12. This sub-frame is the subject of the applicant's co-pending British patent application number 0523174.1 filed the same day as the present application and does not need to be described in further detail herein.

Figure 3:
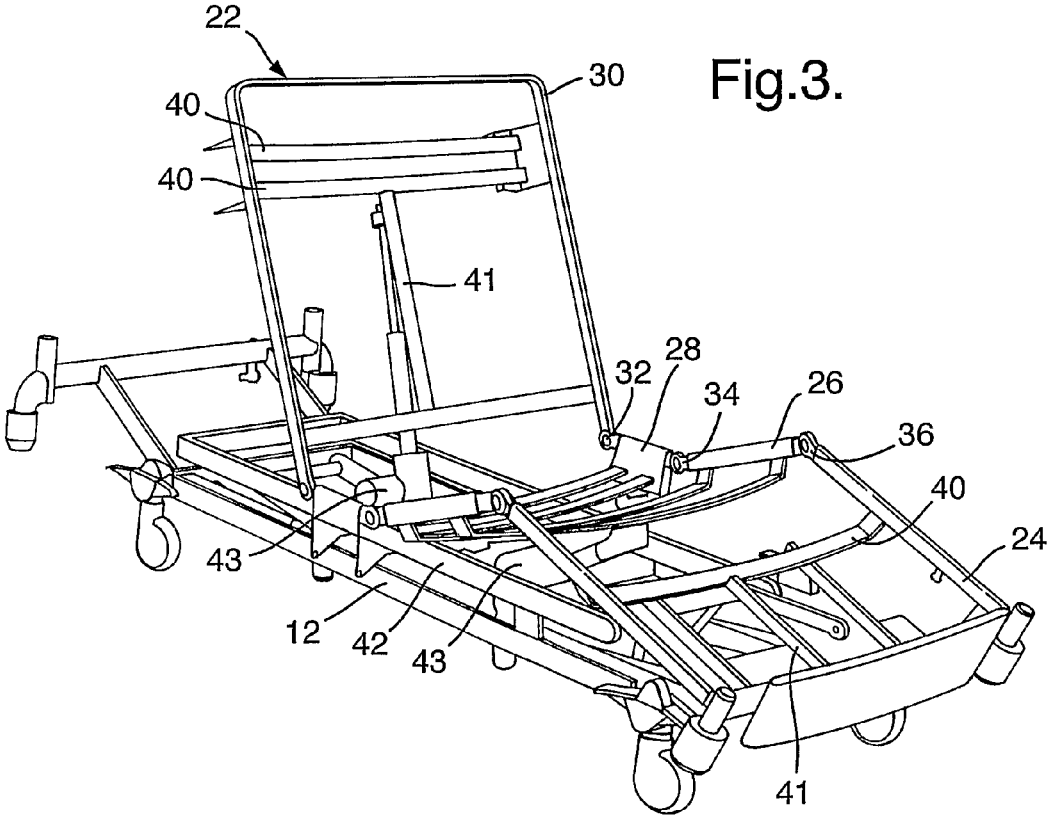
FIG. 3 shows the bed assembly of FIGS. 1 and 2 in the chair configuration with the mattress support panels and patient support panels removed.

Referring now to FIG. 3, there is shown a perspective view of the bed assembly 10 of FIG. 2 but which omits for the purposes of clarity the mattress support panels 50-56, the head board 16, the foot board 18, the patient retention panels 80, 82 and a number of other components shown in FIG. 2.

The transverse struts 40 which depend from the frame 22 are clearly visible in this Figure. They are provided in number and in location where support is needed for the mattress support panels 50-56 and which allow good access to the bed components underlying the platform 20, as will be more apparent from a consideration of FIG. 4. In this embodiment, there are provided three transverse struts 40 in the back rest section 30, in light of the greater weight supported by this section of the bed, and two struts 40 in each of the other sections 24-28. Of course, it is possible to provide just two struts in the section 30 if these are made sufficiently strong.

The back rest section 30, the thigh rest section 26 and the leg rest section 24 are also provided with longitudinally extending strengthening struts 41 between two adjacent transverse struts 40.

It is preferred that the transverse struts 40 are generally rectangular in cross-section as this provides a secure coupling with the snap fasteners provided on the underside of the mattress support panels 50-56.

FIG. 3 also shows two of the actuators 43 used for moving the frame sections 24-30. As can be seen, these are secured to the sub-frame 42.

Figure 4:
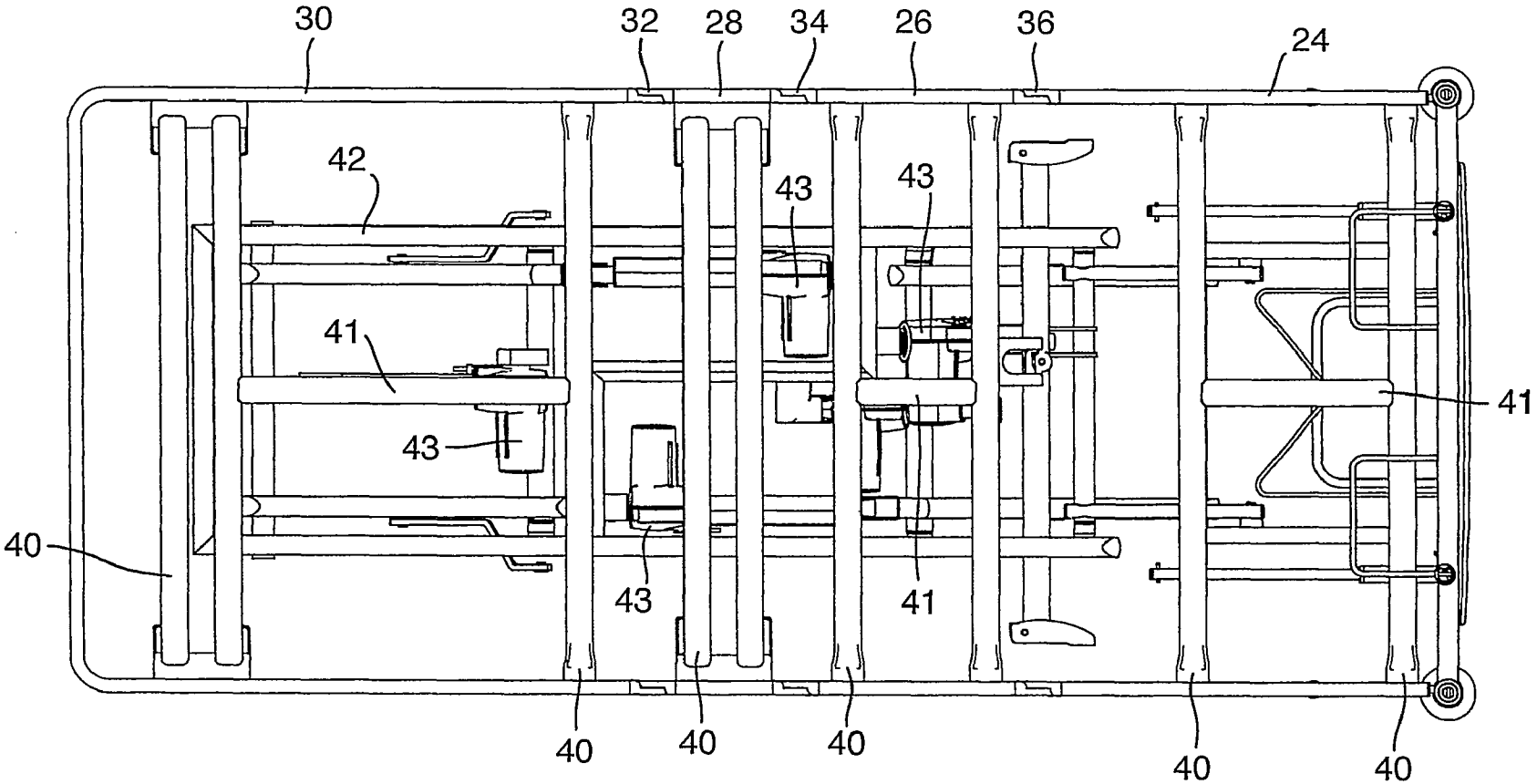
FIG. 4 is a plan view of a part of the bed assembly of FIG. 1.

Referring now to FIG. 4, this shows the bed features of FIG. 3 in plan view with the frame 20 in a flat configuration.

It can be seen that the provision of readily removable mattress support panels 50-56 and of support struts 40, 41, rather than a solid non-removable flat base, provides good access to the components of the bed 10 underlying the frame 22. In this case, the actuators 43 are readily visible and accessible from above the bed 10 through the frame 22, as well as other components such as the control unit (not visible) typically provided in such bed assemblies. This enables servicing of these components from above the bed, that is without having to turn the bed onto its side or upside down.

Figure 5A:
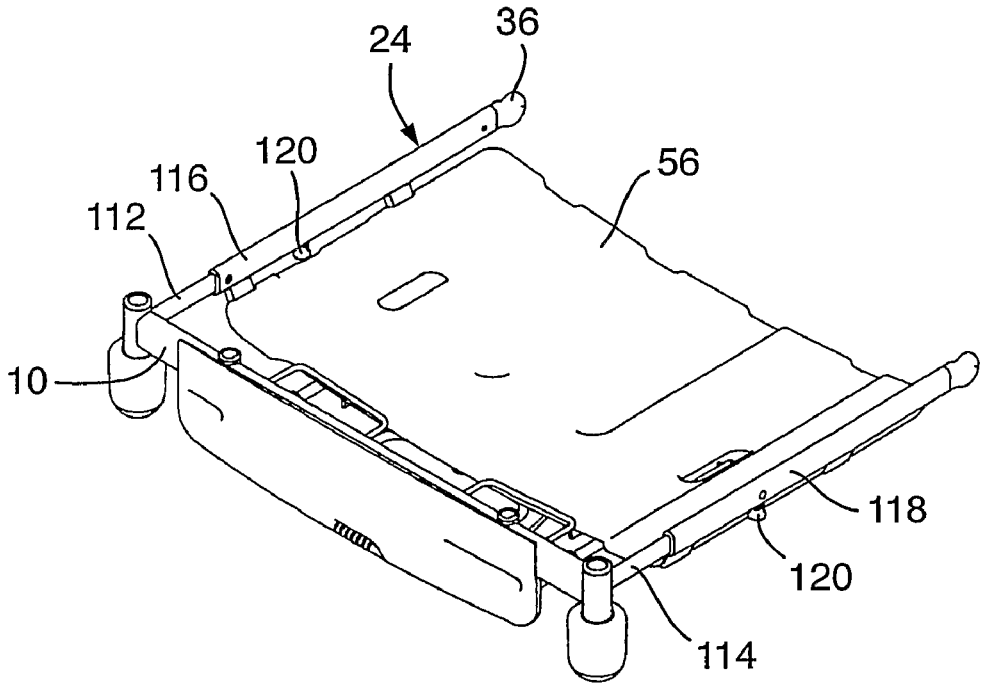
FIGS. 5A and 5B shows a bed extension mechanism in extended and non-extended positions.
Figure 5B:
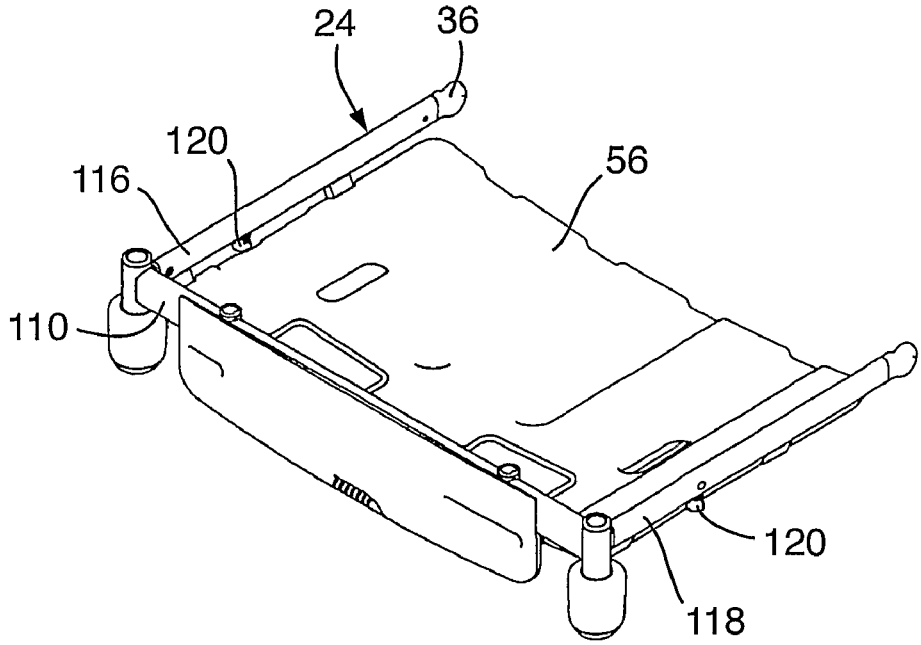

FIGS. 5A and 5B show a detail of the foot section 24 of the frame 22, with its mattress support panel 56 fitted. The end of the foot section 24 is extendable. This is achieved by providing the end strut 110 with first and second parallel rods or tubes 112, 114 either side thereof. These rods have a transverse shape which corresponds to the internal shape of the struts 116, 118 forming the foot rest section 24, so as to be slidable therein as shown in FIGS. 5A and 5B. As will be apparent from FIG. 5A, when the foot rest section 24 is in its extended condition, the rods 112, 114 continue the side wall of the frame 22, thereby retaining the side support surfaces complete around the whole of the frame 22.

First and second latches or locks 120 are provided for locking each rod 112 in either the retracted or in the extended positions. The latches 120 could simply be sprung pins fitting into appropriate apertures or bores in the rods 112, 114 or could be screw locks which tighten against the rods 112. The type of latch or lock is not important.

Figure 6:
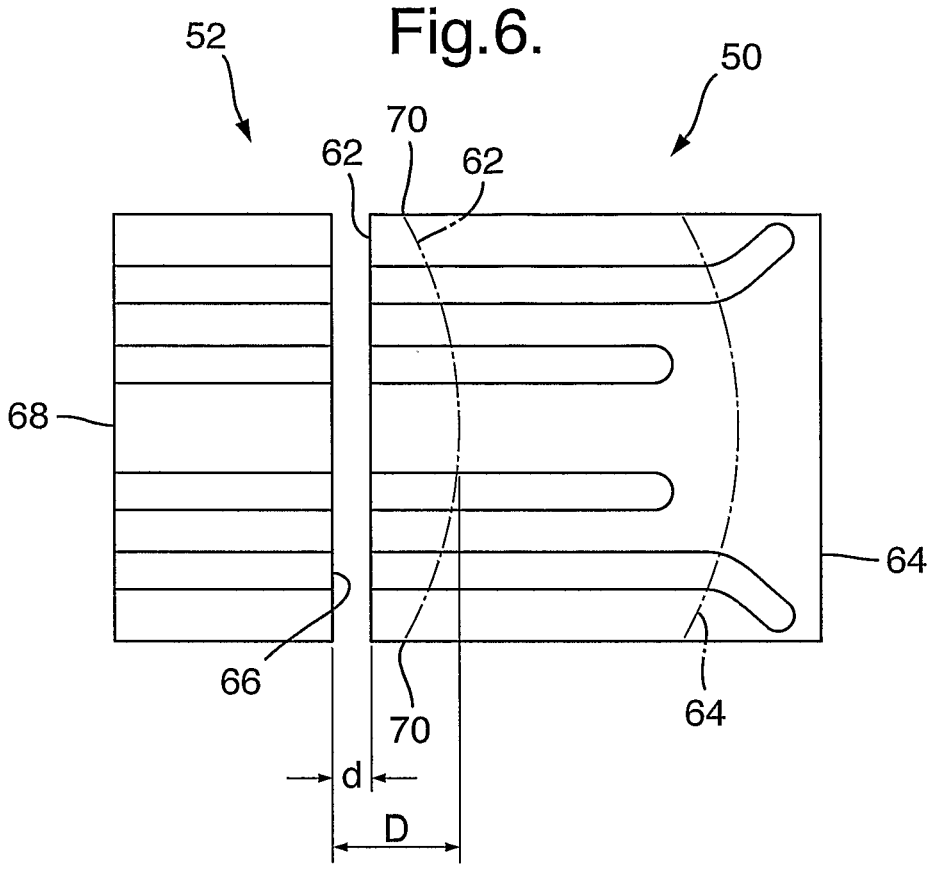
FIG. 6 shows in plan view and in schematic form two mattress support sections of the bed of FIG. 1.

Referring now to FIG. 6, there is shown in plan view in schematic form the arrangement of the mattress support panels 50, 52 of the bed of FIGS. 1 and 2. The support panel 50, which forms the back rest section of the bed 10, includes a first end wall 62 and an opposing end wall 64. The mattress support panel 52, which forms the seat portion of the bed 10, includes a first end wall 66 and a second end wall 68. The walls 62 and 66 are adjacent one another, as shown in FIG. 6.

When the bed is in a flat position, depicted by the solid lines in FIG. 3 and as shown in FIG. 1, the spacing between the two panels 50, 52 is shown as distance d, which can be any suitable distance which will not adversely affect the support of a patient on a mattress laid over the panels 50-56. The distance d will typically be a few centimetres, often around 10 cm or so.

On the other hand, when the support panel 50 is pivoted to a raised patient sitting position as shown in FIG. 2, the distance between the end walls 62, 66 of the panels 50, 52 respectively increases to the distance D shown in FIG. 6. It can be seen that distance D is considerably larger than the distance d when the two panels are lying flat.

There are two primary factors which cause the increase in the distance between the two end walls 62, 66. The first is the curvature of the panels 50, 52 and the fact that the pivoting point is at the sides of the panel. The centre of the panels 50, 52 are substantially below the sides, thereby causing this increase in distance during the pivoting motion. The second factor is that the pivot 32 is raised above even the highest points of the panels 50, 52 (that is above their raised sides) which causes additional movement away from the panel 52 including at the ends 70.

This increase in spacing is advantageous because when a person moves from a lying position to a sitting position the person stretches at the point of bending (that is between the patient's back and lower thighs). Thus, this arrangement follows the extension of the person and therefore makes it much more comfortable to a patient. Prior art beds, which have the pivot points substantially at the level of the mattress support sections and which have mattress support sections which are substantially flat, do not benefit from this increase in spacing between the sections and therefore from any increase in the effective length of the mattress support base. They can provide a pinching effect on the patient.

The reader will appreciate that the two factors mentioned above could be provided independently of one another, although with reduced lengthening effect.

Figure 7:
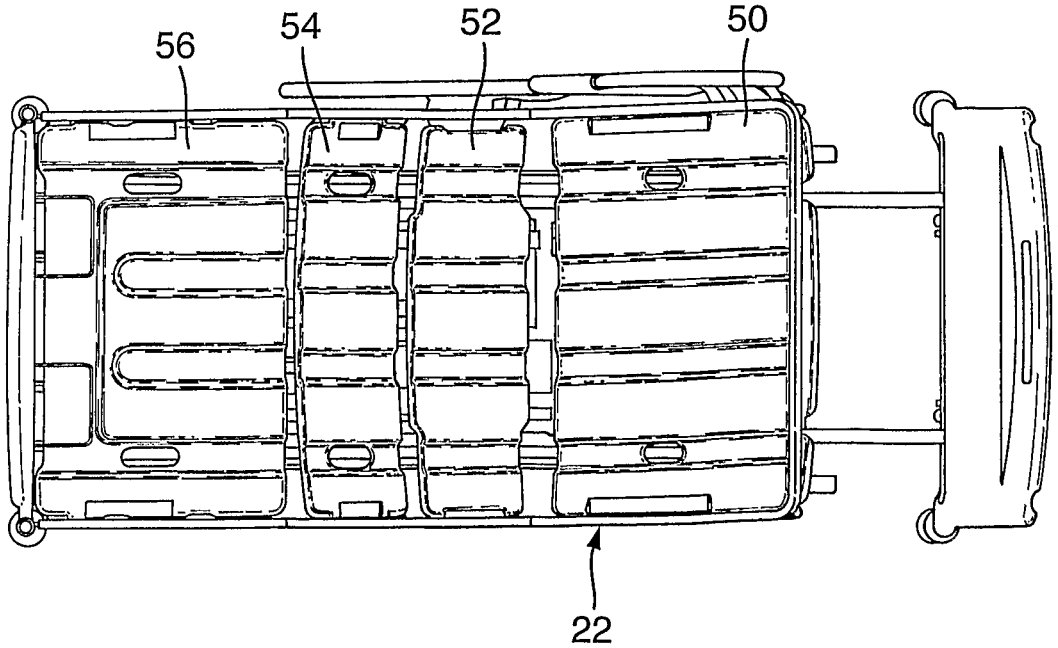
FIG. 7 is a plan view of the bed assembly of FIG. 3.
Figure 8:
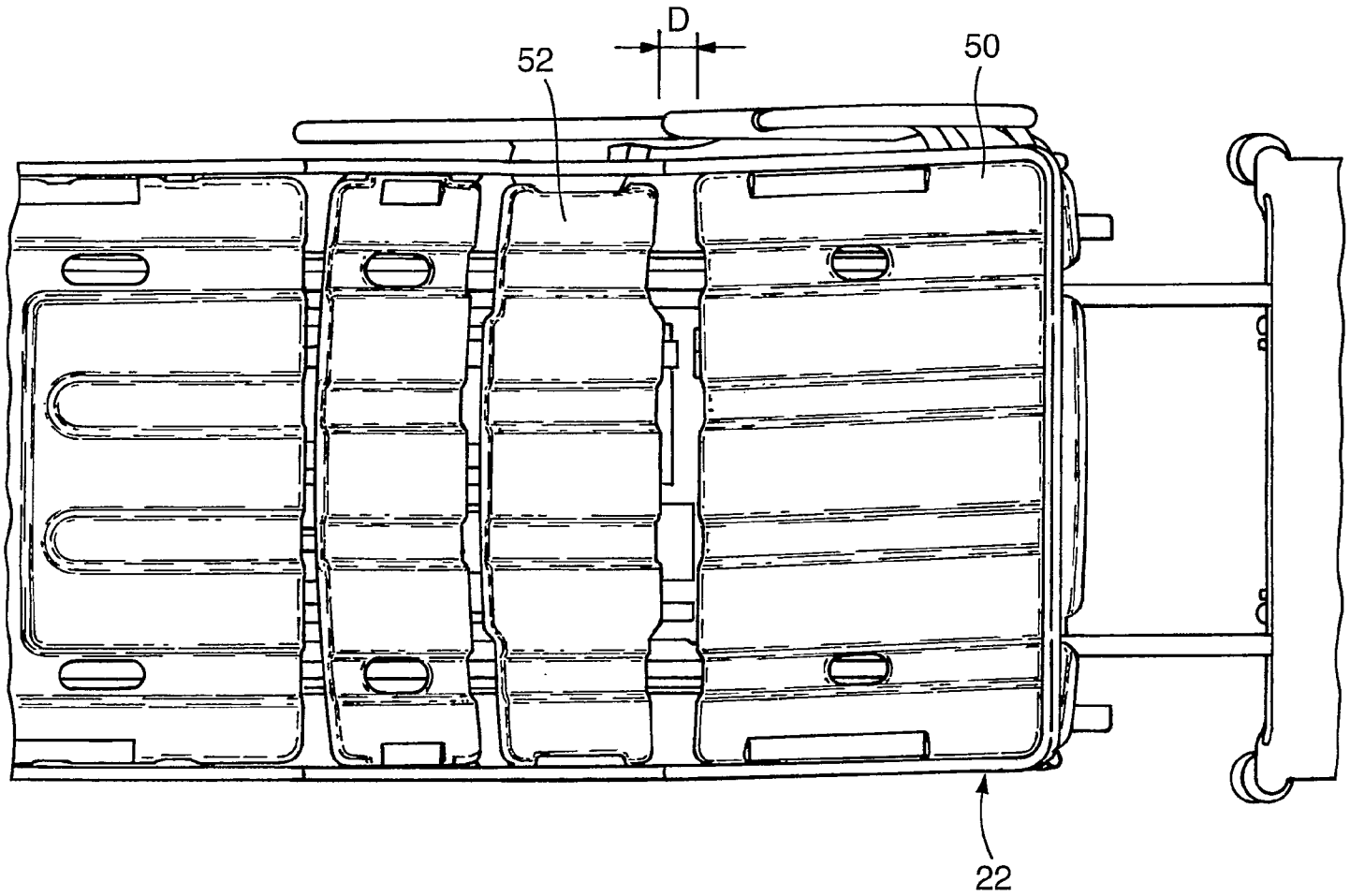
FIG. 8 is an enlarged view of a portion of the plan view of FIG. 7.

FIG. 7 shows a plan view of the bed of FIG. 1 in the chair configuration, while FIG. 8 shows an enlarged view of the head end of the bed of FIG. 7. A comparison of FIG. 1 with FIGS. 7 and 8 shows the increase in spacing between the edges 62, 66 of the panels 50, 52 from the lying to the seating positions.

Figure 9:
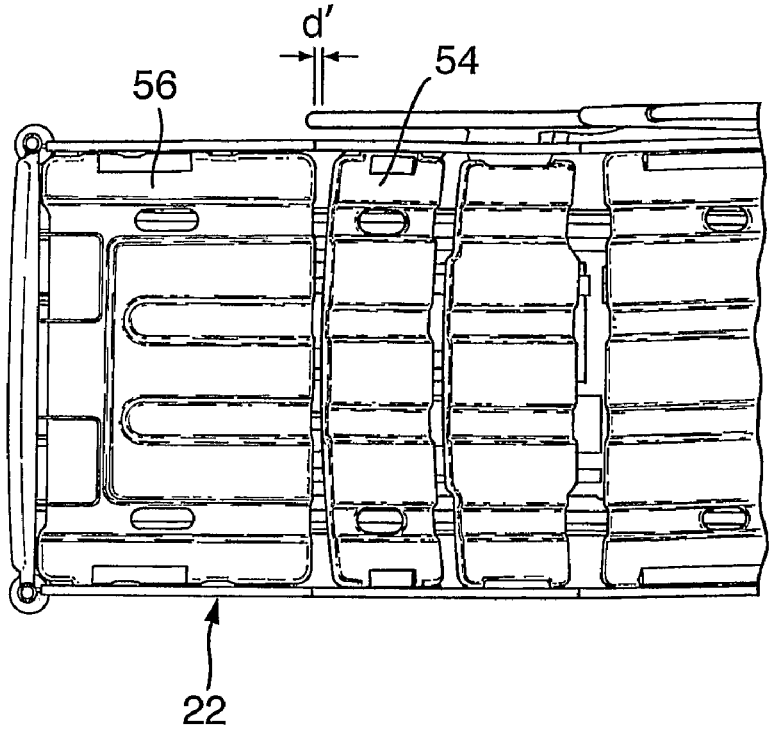
FIG. 9 is an enlarged view of a portion of the plan view of FIG. 7.

There is an other advantageous feature of this structure of the platform 20, this being at the thigh section 54. As can be seen in FIG. 1, the spacing, D', between the thigh rest panel 54 and the leg rest panel 56 is relatively large when the platform 20 is in the flat configuration. However, when the hinge 36 is raised to form the knee break, this spacing is reduced substantially, to d' as shown in FIG. 9. This reduction in spacing causes the lower surface of the mattress to compress longitudinally as a result of a shortening in the overall length of the portions 54, 56 of the mattress support. This enables the mattress to maintain contact with the rear of a patient's knee. It has been found that if there is no such compression of the mattress longitudinally, as would be the case if the spacing between the thigh and leg rest sections 54, 56 were to remain the same, the mattress becomes stretched over the knee break and can lose contact with the rear of a patient's knees, thereby losing the supporting effect it should provide.

Figure 10:
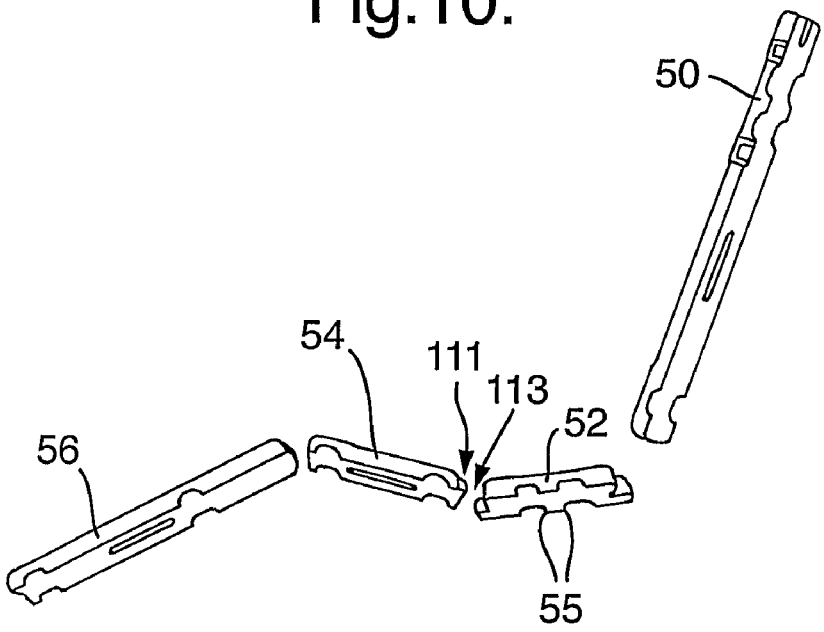
FIG. 10 shows a side elevational view of the mattress support panels only of the bed assembly of FIG. 1, with the bed in a chair configuration.

FIG. 10 shows the mattress support panels 50-56 in the chair configuration of the bed. The spacings between the panels in this configuration can be clearly seen. There is, however, another feature evident in FIG. 10, related to the movement of the thigh rest section 54. As can be seen in FIG. 10, with the thigh rest section pivoted upwardly as shown, the rear edge 111 of the thigh rest 54 is higher than the front edge 113 of the seat section. This is caused by the fact that the rear edge 111 is longitudinally spaced from the hinge 34, along the length of the bed. As a result of this, pivoting of the frame section 28 about the hinge 34 will cause the panel 54 not only to pivot but also to rise relative to its rest position. This rising of the thigh rest panel 54 provides better support to the underside of a patient's thigh than do existing configurable bed assemblies.

Referring now to FIG. 11, the bed 10 is shown in the lying configuration, in order better to see the patient retention panels 80, 82 for retaining the patient on the bed. The panels 80, 82 are typically made from a plastics material or from metal covered with a plastics cladding.

The patient retention panel 80 is coupled to the frame member 30 forming the back rest section of the bed 10 and is able to move therewith, as will be apparent in particular from FIG. 2. The patient retention panel 82 is coupled to the seat section 28 of the frame 22 and in practice does not move as the seat section 28, in this embodiment, is the one stationary member of the frame 22 (although it does, of course, move with the frame 22 as this is raised, lowered and tilted).

As is best appreciated from FIG. 2, when the back rest section 30, 50 is pivoted upwardly towards a patient sitting position, the patient retention panel 80 will move over the retention panel 82. For this purpose, the panel 80 includes a concave facing surface 92 which faces a convex surface 94 of the retention panel 82. As the panel 80 moves upwardly and around the panel 82, the surface 92 slides over the surface 94 retaining substantially the same gap g between the two surfaces 92 and 94. As a result of this, the combination of the two panels 80, 82 provides a substantially continuous support surface throughout the movement of the retention panel 80, without creating between the two panels any constriction which could trap part of a patient's body or that of hospital staff.

Figure 12:
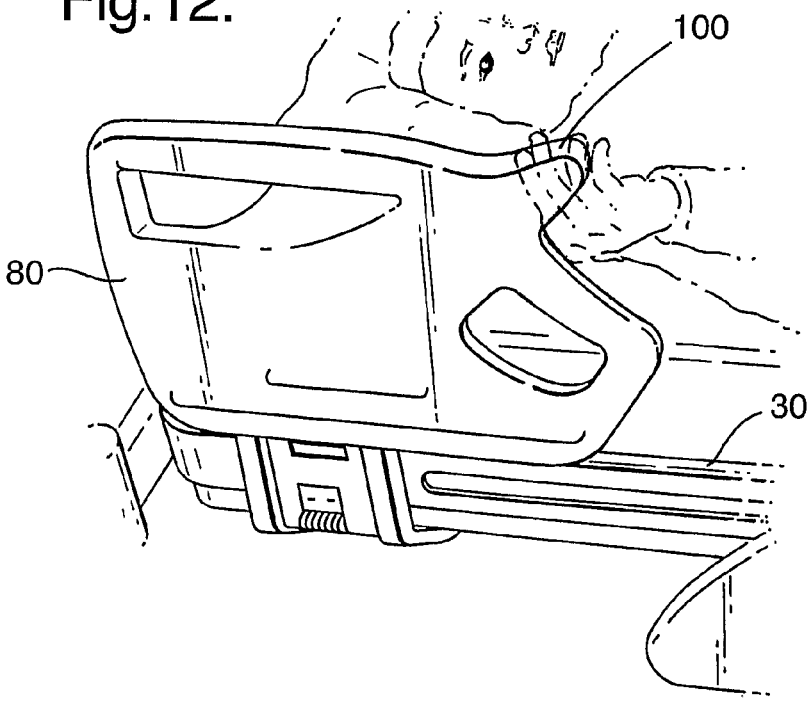
FIG. 12 shows a keypad zone of the bed of FIG. 1 in use by a patient.

As shown in particular in FIGS. 11 and 12, there can be seen in schematic form an example of a preferred embodiment of unit 100 for supporting a keypad (not shown) which allows the patient to operate the various functions of the bed 10.

In this embodiment, the keypad unit 100 is provided with a protruding member 102 which extends beyond the general outer perimeter of the patient support panel 80 and in a direction towards the foot end of the bed 10. The unit 100 is fitted to the patient retention panel 80 so as to move with that panel upon movement of the back rest section 30, 50, in such a manner that it maintains its position relative to the backrest section 30, 50 and hence relative to a patient lying on the bed 10. The unit 100 is located so as to be easily accessible by a patient on the bed by means of the patient's hand at that side of the bed, as shown in particular in FIG. 6. The position of the unit 100 could be described as being approximately at the shoulder area of a patient lying or sitting on the bed 10.

As can also be seen in FIG. 12, the shape and structure of the unit 10 is such that a patient is able to place his/her fingers on the outer side of the unit 100 and then to operate a keypad (not shown) on the inner/patient side of the unit 100. The patient is therefore able to apply an opposing pressure at the rear side of the unit 100 to the pressure applied when pressing the buttons of the key pad, which in practice stabilises the unit 100. This feature contrasts with the existing keypads provided on the patient support panels, which tend to be difficult to operate because the panels generally have some flexibility to them.

The keypad which would be provided in the unit 100 is of a type equivalent to the keypads already used in such beds and therefore is not described in any further detail herein.

Referring in particular to FIG. 11, it is preferred that the unit 100 is fitted to the patient support panel 80 by first and second flanges 104, 106 which can be secured to the panel 80 either by suitable snap fit connections and/or by one or more screws. Within the unit 100 there is provided a plug or socket which fits to a complimentary socket/plug to make the necessary electrical connections between the keypad of the unit 100 and the control system of the bed 10.

The preferred structure of the keypad unit 100 facilitates the assembly of the unit 100 to the bed 10 and also enables its easy replacement in case the keypad is in some way damaged during use or shipping.

The invention claimed is:

1. A mattress support for a bed including two or more support sections arrayed along the length of the mattress support, the support sections including:

a. a backrest support section, and b. one or more of:

(1) a seat support section next to the backrest support section, (2) a thigh rest support section next to any seat support section, (3) a leg rest support section next to any thigh rest support section, each support section having:

i. section sides situated on opposite sides of the length of the mattress support, and ii. an at least substantially rigid upper surface which is fixed in a curved configuration between the opposing section sides, wherein the support sections are movable relative to each other such that the curved upper surfaces of the support sections can be arranged at different angles with respect to each other.

2. The mattress support of claim 1 wherein each support section is pivotable:

a. relative to an adjacent support section, and b. about an axis oriented between the opposing section sides.

3. The mattress support of claim 1 in combination with a bed frame, the bed frame having:

a. a length extending between opposing bed frame sides, and b. struts extending between the opposing bed frame sides, wherein each support section is removably supported on one or more of the struts.

4. The mattress support of claim 1 wherein each support section is:

a. formed of plastic, and b. at least substantially hollow.

5. The mattress support of claim 4 wherein each support section has a lower surface with a pair of bosses thereon, the bosses defining a space therebetween into which a supporting strut may be fit.

6. The mattress support of claim 4 wherein each support section includes one or more cut-out areas therein, each cut-out area defining a void within the support section wherein the void is spaced from the section sides.

7. The mattress support of claim 6 wherein the void defined by one or more of the cut-out areas:

a. extends between opposing upper and lower surfaces of its support section, and b. is bounded by its support section as it extends between the opposing upper and lower surfaces of its support section, whereby the void defines a passage extending through the support section.

8. The mattress support of claim 1 in combination with a bed frame, the bed frame having two or more frame sections which are:

a. arrayed along the length of the bed frame, and b. pivotable with respect to each other about pivot axes oriented between opposing bed sides, wherein each support section is situated on one of the frame sections with the upper surface of the support section situated below the pivot axes of the bed frame.

9. The combination of claim 8 wherein:

a. each frame section includes:

(1) opposing bed frame sides extending along the length of the mattress support, and (2) struts extending between the opposing bed frame sides, wherein each support section rests atop one or more of the struts, b. the pivot axes extend:

(1) between adjacent frame sections, and (2) between the opposing bed frame sides.

10. The combination of claim 9 wherein the struts are spaced below the opposing bed frame sides.

11. The combination of claim 8 wherein each support section is removably supported on one of the frame sections.

12. The mattress support of claim 1 in combination with:

a. a bed frame whereupon the support sections are supported, the bed frame including opposing bed frame sides adjacent the section sides, b. a patient retention panel adjacent one of the bed frame sides, the patient retention panel having:

(1) opposing inner and outer panel faces extending along planes oriented in the direction of the length of the mattress support, and (2) a bounding perimeter extending between the inner and outer panel faces, wherein a portion of the bounding perimeter defines an elongated protrusion with respect to adjacent portions of the bounding perimeter, the protrusion:

i. extending outwardly from the bounding perimeter to terminate in a free end, the free end being surrounded by open space whereby the protrusion is readily graspable by a patient without interference, and ii. defining less than one sixth of the bounding perimeter.

13. The mattress support of claim 12 wherein the protrusion includes one or more buttons on the inner panel face.

14. The mattress support of claim 12 wherein the protrusion:

a. has a thickness measured between the inner and outer panel faces and a width oriented perpendicularly to the thickness, the width being no greater than approximately twice the thickness, and b. includes one or more buttons on the inner panel face.

15. The mattress support of claim 1 in combination with a bed frame having:

a. adjacent frame sections which each:

(1) have opposing bed frame sides adjacent the section sides, (2) support one of the support sections, and (3) are pivotable with respect to each other about axes oriented between the section sides, b. adjacent patient retention panels which each:

(1) extend adjacent one of the bed frame sides, (2) include opposing inner and outer panel faces extending along planes oriented in the direction of the length of the mattress support, and (3) include a bounding perimeter extending between the inner and outer panel faces, wherein the bounding perimeter of one of the patient retention panels is curved such that this bounding perimeter travels:

i. adjacent the bounding perimeter of the other of the patient retention panels, ii. with the bounding perimeters of the patient retention panels translating in opposite directions with respect to each other, as the frame sections pivot with respect to each other.

16. A bed having a length extending between opposing bed sides, the bed including:

a. a mattress support including two or more support sections arrayed along the length of the bed, the support sections including:

(1) a backrest support section, and (2) a seat support section next to the backrest support section, each support section having:

i. section sides situated adjacent the opposing bed sides, and ii. an at least substantially rigid upper surface sloping in a fixed concave curve between the section sides;

b. a bed frame, the bed frame having frame sections which are:

(1) arrayed along the length of the bed, and (2) pivotable with respect to each other about pivot axes extending between the opposing bed sides, wherein each support section is situated on one of the frame sections, with the curved upper surface of the support section situated below any pivot axes for the frame section on which the support section is situated.

17. The bed of claim 16 wherein each support section is removably supported on one of the frame sections.

18. The bed of claim 16 wherein each frame section includes:

a. opposing bed frame section sides extending along the length of the bed, and b. struts extending between the opposing bed frame section sides, wherein each support section is removably supported on one or more of the struts.

19. The bed of claim 18 wherein each support section has a lower surface with a depression therein, the depression defining a space into which one of the struts may be closely fit.

20. The bed of claim 16 wherein each support section is:

a. formed of plastic, and b. at least substantially hollow.

21. A bed having a length extending between opposing bed sides, the bed including:

a. a bed frame including:

i. a backrest frame section, and ii. a seat frame section next to the backrest frame section, the frame sections:

(1) being situated in series along the length of the bed, (2) being pivotable with respect to each other about a pivot axis extending between the opposing bed sides, and (3) having central frame supports extending between the opposing bed sides, the frame supports being situated in planes spaced from the pivot axis;

b. a mattress support including:

i. a backrest support section supported by the backrest frame section, and ii. a seat support section supported by the seat frame section, each support section including:

(1) an at least substantially rigid upper surface, (2) section sides situated adjacent the opposing bed sides, and (3) opposing section ends extending between the section sides, wherein the distance between the adjacent section ends of the backrest support section and the seat support section varies between a minimum spacing and a maximum spacing as the frame sections pivot with respect to each other over their operational range of motion, the maximum spacing being at least twice the minimum spacing.

22. The bed of claim 21 wherein the upper surfaces of the support sections have a fixed configuration which concavely curves between the section sides.

23. The bed of claim 21 further including a patient retention panel adjacent one of the frame sections, the patient retention panel:

a. being movably linked with respect to the frame section, and b. having:

(1) major areas which extend at least substantially parallel to the length of the bed, and (2) a bounding perimeter extending between the inner and outer panel faces, wherein a minor portion of the bounding perimeter defines an elongated protrusion with respect to adjacent portions of the bounding perimeter, the protrusion extending outwardly from the bounding perimeter to terminate in a free end, the free end being surrounded by open space whereby is the inner and outer panel faces of the protrusion are simultaneously readily graspable by a patient without interference.

24. The bed of claim 23 wherein the protrusion bears one or more buttons thereon.

* * * * *